US005797457A

United States Patent [19]

Sundholm

[11] Patent Number: 5,797,457

[45] Date of Patent: Aug. 25, 1998

[54] METHOD FOR FIGHTING FIRE IN A NARROW SPACE

[76] Inventor: Göran Sundholm, Ilmari Kiannon kuja 3, FIN-04310 Tuusula, Finland

[21] Appl. No.: 624,401

[22] PCT Filed: Oct. 3, 1994

[86] PCT No.: PCT/FI94/00422

§ 371 Date: Mar. 29, 1996

§ 102(e) Date: Mar. 29, 1996

[87] PCT Pub. No.: WO95/09677

PCT Pub. Date: Apr. 13, 1995

[30] Foreign Application Priority Data

Oct. 1, 1993 [FI] Finland ..... 934340

[51] Int. Cl.[6] ..... A62C 3/10

[52] U.S. Cl. ..... 169/46; 169/9; 169/16; 169/62

[58] Field of Search ..... 169/5, 9, 16, 17, 169/18, 43, 46, 47, 62

[56] References Cited

U.S. PATENT DOCUMENTS

| | | | |
|---|---|---|---|
| 2,295,571 | 9/1942 | Ensminger et al. | 169/47 |
| 5,125,458 | 6/1992 | Berman | 169/16 |

FOREIGN PATENT DOCUMENTS

| | | | |
|---|---|---|---|
| 572752 | 2/1976 | Switzerland | 169/16 |
| 92/20453 | 11/1992 | WIPO . | |
| 93/25276 | 12/1993 | WIPO . | |

*Primary Examiner*—Andrew C. Pike
*Attorney, Agent, or Firm*—Ladas & Parry

[57] ABSTRACT

A method for fighting a fire in a narrow space fog-form sprays an extinguishing medium in a direction along the narrow space from a first nozzle and fog-form sprays the extinguishing medium in the direction along the narrow space from a second nozzle that is spaced from the first nozzle in the direction along the narrow space for the fog-form sprayings to strengthen each other in capacity and penetration from availability of air behind and close to each of the nozzles.

6 Claims, 1 Drawing Sheet

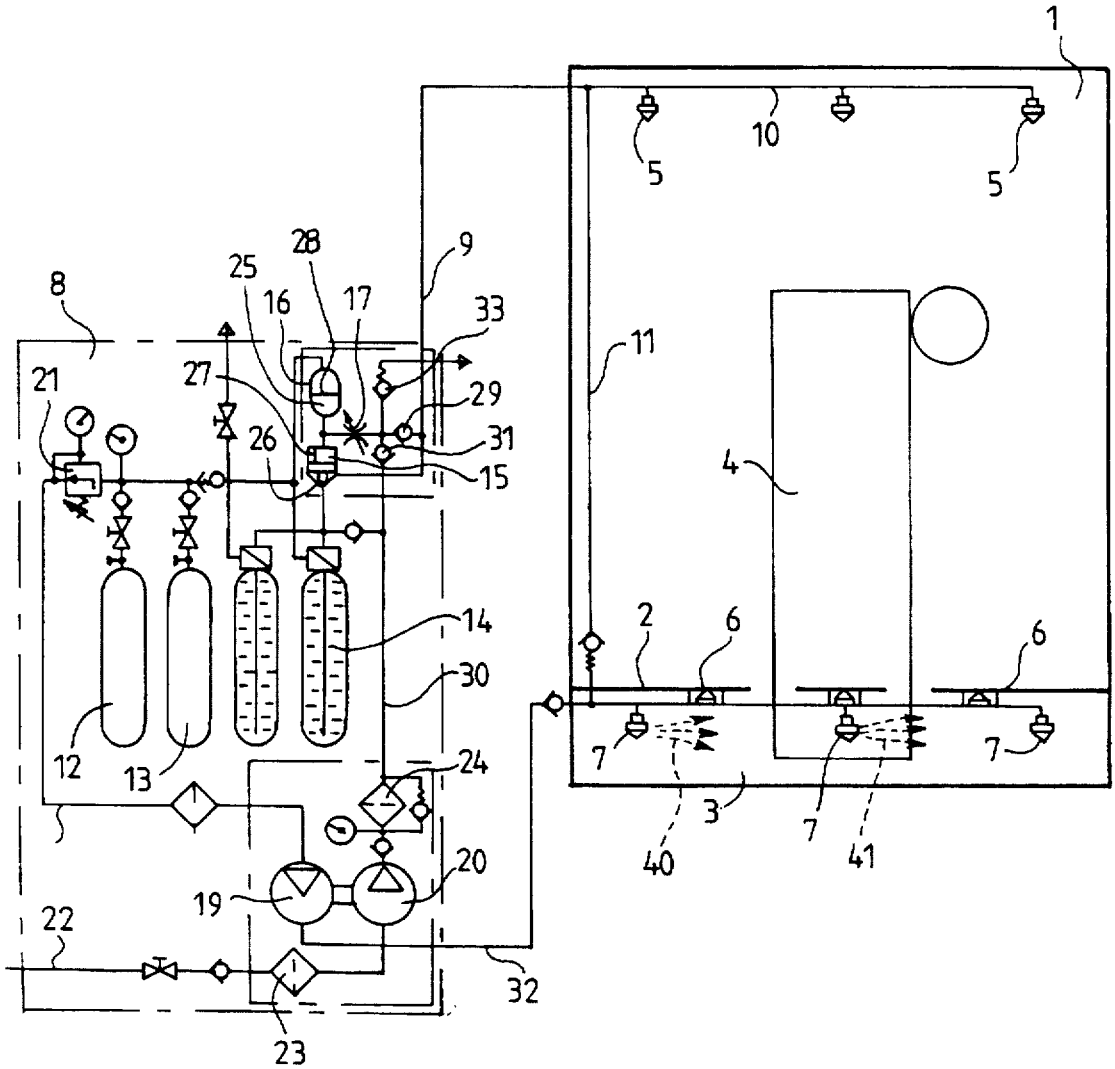
1
10
5
5
9
28
25
16
17
33
8
11
21
27
29
26
31
15
4
14
2
6
6
30
12
13
24
7
7
3
7
40
41
20
19
22
32
23

METHOD FOR FIGHTING FIRE IN A NARROW SPACE

The present invention relates to a method for fighting fire, especially for fire-fighting in engine rooms of ships and spaces comparable with them.

FIG. 1 in the Finnish Patent Application 933997 shows a number of nozzles, sprinklers or spray heads in a bilge space of an engine room. The spray heads in question are directed downwards.

The object of the invention is to improve this arrangement and to provide an effective fire-fighting especially in narrow and possibly winding spaces, such as bilge spaces, channels, and cupboard constructions of different kinds, etc.

The purpose of the invention is to direct the spray heads in said spaces one after the other, say in a series, so that a spray head behind sprays towards the next spray head in front.

In engine rooms of ships, the spray heads are preferably positioned in a circle around the engine.

By directing the spray heads one after the other, fog streams from the individual spray heads will strengthen each other and simultaneously secure a necessary availability of air behind and close to each spray head, so that it is possible, according to what is wished, to achieve strong fog streams having a high capacity to penetrate and carry off. For this purpose, the spray heads may preferably be constructed according to what is set forth in the International Patent Application PCT/FI92/00155 (publication WO92/20453), which is incorporated by reference.

In the following, the invention will be described in greater detail with reference to an embodiment shown in the attached FIGURE.

In the FIGURE, an engine room is indicated by reference numeral 1, the engine room floor is indicated by 2, a bilge space below the floor is indicated by 3, and the engine in question, e.g., a diesel engine, is indicated by 4. Up to the ceiling of the engine room are positioned a number of sprinklers or spray heads 5 and on the floor level are arranged a number of spray heads and/or sprinklers 6 directed upwards and a number of nozzle heads 7 directed around the bilge space 3.

A drive unit for delivering extinguishing liquid and/or extinguishing gas is indicated by 8. An outgoing liquid line 9 of the drive unit 8 can be connected selectively to different fire zones; the engine room 1 constitutes a fire zone comprising a feederline 10 to the spray heads 5 at the ceiling of the engine room and a branching 11 to the spray heads 6, 7 at the engine room floor 2.

The drive unit 8 comprises two pressure gas containers 12 and 13 having an initial charging pressure of e.g., 200 bar and automatically or manually controllable outlet valves for leading pressure gas into and driving extinguishing liquid out of two liquid containers 14 through the line 9. The pressure gas containers 12 can be constituted by so-called standard gas bottles. The extinguishing liquid from the containers 14 is arranged to flow into the line 9 via a valve 15, the opening of which effected by the liquid pressure is, however, counteracted by a liquid cylinder 16 arranged in connection with the pressure of the propellent gas, in combination with a throttle 17, as will be described in more detail below.

A common outlet line 18 of the propellent gas containers 12 and 13 is connected via a pressure reducing valve 21 adjustable for 10 bar, besides to the liquid containers 14, also to a low-pressure water pump 19, 20, whereby 19 indicates a pneumatic driving motor for the actual water pump 20 having an operating pressure of e.g., about 16 bar. Alternatively, it is possible to use a low-pressure pump of another kind, e.g., a double-acting piston pump. The pump 20 sucks water from a fresh-water container via a line 22 or, e.g., sea or lake water, alternatively. The water is filtered by means of filters 23 and 24 to a particle level of 10 μ, for instance. Occurring variations in pressure may be balanced by means of an accumulator not shown in FIGURE.

The FIGURE shows the equipment ready for being used. The pressure bottles 12 and 13 are filled with propellent gas, having a pressure of, e.g., 200 bar, and the liquid bottles 14 are filled with water, as is the liquid cylinder 16, the filled liquid space of which is indicated by 25. A spring 27, which may be relatively weak, keeps the spindle 26 of the valve 15 in the shown position closing the valve.

When a fire is detected, one of the propellent gas containers, e.g., the container 12, is switched on at first, whereby the gas strives to drive the liquid out of the containers 14 via the valve 15 to the outlet line 9, 10 by pressing up the valve spindle 26 from the position of the FIGURE under the influence of the liquid pressure.

However, the same gas pressure also acts on a membrane 28 of the liquid cylinder 16, which membrane may also be a piston, and therefore presses the liquid 25 out partly via the throttle 17 and a subsequent nonreturn valve 29 into the line 9, but partly also towards the spindle 26 of the valve 15 against the effect of the liquid pressure from the containers 14. As shown schematically in the drawing, by making the spindle 26 surface affected by the pressure of the cylinder liquid 25 larger than the spindle 26 surface affected by the equally high pressure of the extinguishing liquid of the containers 14, e.g. in the proportion 2.5:1, the valve 15 will remain closed until the liquid 25 has been pressed out of the cylinder 16 entirely and its pressure has subsequently sunk via the throttle 17 to about 40 bar in the present example case, whereby the extinguishing liquid is able to press away the spindle 26 of the valve 15.

During the just-described initial stage, the length of which may be adjusted as desired by means of the throttle 17, the pressure gas drives, however, via the line 18 and the pressure reducing valve 21, the pump 20 delivering liquid via its outlet line 30, having the filter 24 and a nonreturn valve 31 after filler branching to the containers 14, to the outlet line 9 of the drive unit 8 over the nonreturn valves 29 and 31, for an initial cooling of at least the spray heads 5 and the parts of the line 10 which extend in the engine room 1. The pressure of the cylinder liquid 25 after the throttle 17 is lower than the outlet pressure of the pump 20. Additionally, the pneumatic motor 19 can deliver gas via an outlet line 32 to the nozzles 7 in the bilge space 3 of the engine room 1.

Upon opening the valve 15, the driving of the extinguishing liquid out of the containers 14 will begin and the pump 20 stops when the nonreturn valves 29 and 31 are closed. Excess liquid pressed by the valve 15 into the line space around the throttle 17 is allowed to flow out through an overflow valve 33, which may be adjusted for e.g., 16 bar. The gas container 12 and the liquid containers 14 can be dimensioned for instance in such a way that, with the containers 14 emptied of liquid, a gas pressure of about 80 bar prevails in them and in the container 12. Gas will then continue flowing out after the liquid through the line 9 until the pressure has sunk so much that the pressure in the space around the throttle 17 is able to close the valve 15. If the last-mentioned pressure is about 16 bar, the valve 15 is closed at a pressure of about 40 bar in the containers 14, and subsequently, the remaining gas in the containers 12 and 14 continues driving the pump 20.

The pump 20 now refills the containers 14 with water. If the overflow valve 33 is adjusted to a value somewhat higher than the outlet pressure of the pump 20, liquid is delivered also to the outlet line 9 exactly in the same way as during the initial stage described previously, and simultaneously, the cylinder 16 is refilled with water. When the containers 14 have been filled, the procedure can be repeated by switching on the other pressure gas container 13.

Both during the initial stage and during the liquid filling stage, the pneumatic motor 19 can also deliver propellent gas, say nitrogen or argon gas, via a gas line 32 extending from the motor 19 and via the nozzles 7 to the bilge space 3 of the engine room.

According to the invention, the nozzles 7 in the bilge space are directed one after the other, as shown by an arrow 40 as far as the left nozzle 7 is concerned. A further nozzle indicated by an arrow 41 may be positioned between the left and the right nozzle in the FIGURE. The nozzle 7 on the right side in the FIGURE may be directed into the plane of the drawing; all nozzles 7 in the bilge space constitute preferably a circle around the engine 4 to strengthen each other for circulation of the fog sprays in the bilge space around the engine.

The same principle may preferably be applied also to other kinds of narrow and winding spaces.

I claim:

1. A method for fighting a fire in a narrow space comprising:

fog-form spraying (40) an extinguishing medium in a direction along the narrow space from a first nozzle (7); and fog-form spraying (41) the extinguishing medium in the direction along the narrow space from a second nozzle (7) spaced from the first nozzle (7) in the direction along the narrow space for the fog-form sprayings (40, 41) from the nozzles (7) to strengthen each other in capacity and penetration from availability of air behind and close to each of the nozzles.

2. A method according to claim 1, wherein the narrow space is around an inflammable object and the direction is around the inflammable object.

3. A method according to claim 2, wherein the narrow space is a bilge space (3) of a ship.

4. A method according to claim 3, wherein the nozzles are on respective spray heads or sprinklers.

5. A method according to claim 2, wherein the nozzles are on respective spray heads or sprinklers.

6. A method according to claim 1, wherein the nozzles are on respective spray heads or sprinklers.

* * * * *

UNITED STATES PATENT AND TRADEMARK OFFICE

CERTIFICATE OF CORRECTION

PATENT NO. : 5,797,457
DATED : August 25, 1998
INVENTOR(S) : Goran Sundholm

It is certified that error appears in the above-indentified patent and that said Letters Patent is hereby corrected as shown below:

On title page, item 86, "PCT/FI94/00422" should be --PCT/FI94/00442--.

Signed and Sealed this

Eighth Day of December, 1998

*Attest:*

*Attesting Officer*

BRUCE LEHMAN

*Commissioner of Patents and Trademarks*